US009464781B1

(12) United States Patent
Bach

(10) Patent No.: US 9,464,781 B1
(45) Date of Patent: Oct. 11, 2016

(54) USER INTERFACE ASSEMBLY FOR AN APPLIANCE

(71) Applicant: General Electric Company, Schenectady, NY (US)

(72) Inventor: James Carter Bach, Seymour, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 7 days.

(21) Appl. No.: 14/681,144

(22) Filed: Apr. 8, 2015

(51) Int. Cl.
*F21V 7/00* (2006.01)
*F21V 7/06* (2006.01)
*F21W 131/30* (2006.01)

(52) U.S. Cl.
CPC ..... *F21V 7/0008* (2013.01); *F21V 7/06* (2013.01); *F21W 2131/30* (2013.01)

(58) Field of Classification Search
CPC .... F21V 7/0008; F21V 7/06; F21W 2131/30
USPC ..... 362/23.14, 92
See application file for complete search history.

(56) References Cited

U.S. PATENT DOCUMENTS

| | | | | |
|---|---|---|---|---|
| 5,130,761 | A | 7/1992 | Tanaka | |
| 7,262,438 | B2 | 8/2007 | Mok et al. | |
| 2013/0027903 | A1* | 1/2013 | Takahashi | B60K 35/00 362/23.14 |
| 2013/0248344 | A1 | 9/2013 | Stilwell | |

* cited by examiner

*Primary Examiner* — Laura Tso
(74) *Attorney, Agent, or Firm* — Dority & Manning, P.A.

(57) ABSTRACT

An appliance configured to uniformly illuminate features of a user interface of the appliance is provided. More specifically, a user interface assembly including a reflective surface for reflecting light from one or more light sources to uniformly and/or evenly illuminate one or more features of a user interface is provided. In particular, a user interface assembly configured to uniformly illuminate relatively large graphical and/or textual features of a user interface is provided. Moreover, a reflective surface designed to enhance and/or brighten the illumination of a sub-feature within a larger illuminated feature of a user interface is provided.

19 Claims, 6 Drawing Sheets

USER INTERFACE ASSEMBLY FOR AN APPLIANCE

FIELD OF THE INVENTION

The subject matter of the present disclosure relates generally to user interface assemblies for appliances, in particular cooktop appliances.

BACKGROUND OF THE INVENTION

Cooktop appliances typically can include a variety of configurations. As an example, cooktop appliances may use a glass and/or ceramic-glass cooking panel for supporting cooking utensils. For such cooktop appliances, the heating sources can include, e.g., radiant, induction, and gas on glass. A variety of controls can be provided for the heating sources such as, e.g., traditional rotatable knobs and/or electronic types that rely on sensitivity to a user's touch. These controls may be provided as part of a user interface assembly for controlling various operations of the cooktop appliance. Similarly, other appliances, such as, e.g., washing machine appliances, refrigerator appliances, and the like, may use user interface assemblies for controlling various operations of the appliance.

Such user interface assemblies may use a variety of lighted text, digits, and/or symbols to display information to a user of the appliance on the surface of the appliance. For example, the upper surface of the cooking panel may include a user interface area where the controls are located, as well as where information such as, e.g., whether a heating element is activated or at what heat level a heating element is set, may be displayed to the user using lighted text, digits, and/or symbols. Typically, the sources of light for the lighted features of the user interface are essentially point-sources, such as, e.g., light emitting diodes or LEDs, such that the features may not be evenly or uniformly lit. For example, the region of the illuminated feature that is closest to the light source illuminating the feature is brighter than the regions that are further from the light source, particularly for relatively large graphical or textual features. However, uniform and/or even lighting of, e.g., text labels, is desirable for the overall appearance of the user interface, as well as the readability of the graphics, text, and the like by the user. Although adding light sources around the perimeter of the features could more evenly illuminate the features, additional light sources would increase the cost of the appliance as well as reduce the reliability of the appliance.

Accordingly, an appliance configured to uniformly illuminate features of a user interface of the appliance would be beneficial. A user interface assembly configured to uniformly illuminate features of a user interface that also minimizes the number and/or size of light sources required to uniformly illuminate the user interface features would be especially useful.

BRIEF DESCRIPTION OF THE INVENTION

The present invention provides an appliance configured to uniformly illuminate features of a user interface of the appliance. More specifically, a user interface assembly including a reflective surface for reflecting light from one or more light sources to uniformly and/or evenly illuminate features of a user interface is provided. In particular, the present invention provides a user interface assembly configured to uniformly illuminate relatively large graphical and/or textual features of a user interface. Additional aspects and advantages of the invention will be set forth in part in the following description, may be apparent from the description, or may be learned through practice of the invention.

In a first exemplary embodiment, a user interface assembly for an appliance is provided. The user interface assembly includes a panel having a user interface surface accessible by a user of the user interface assembly and an opposing surface opposite the user interface surface. The assembly also includes a printed circuit board having a first surface opposite a second surface. The first surface is positioned adjacent the opposing surface of the panel, and the printed circuit board defines a first aperture therethrough. Further, the user interface assembly includes a light source positioned on the second surface of the printed circuit board. The light source is positioned such that light rays from the light source are directed away from the user interface surface. Also, the assembly includes a primary reflective surface spaced apart from the light source, the primary reflective surface positioned such that light rays from the light source are directed toward the primary reflective surface. The primary reflective surface is shaped to reflect the light rays from the light source to the first aperture in the printed circuit board such that the light rays are distributed essentially uniformly within the first aperture.

In a second exemplary embodiment, a user interface assembly for an appliance is provided. The user interface assembly includes a panel including a user interface and a light source for illuminating a feature of the user interface. The light source is positioned such that light rays from the light source are directed away from the user interface. The user interface assembly also includes a primary reflective surface located opposite the light source such that light rays from the light source are directed toward the primary reflective surface. The primary reflective surface is shaped to reflect the light rays toward the feature of the user interface such that the light rays are essentially uniformly distributed within the user interface feature being illuminated.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same reference numerals in different figures denotes the same or similar features.

DETAILED DESCRIPTION OF THE INVENTION

Figure 1:
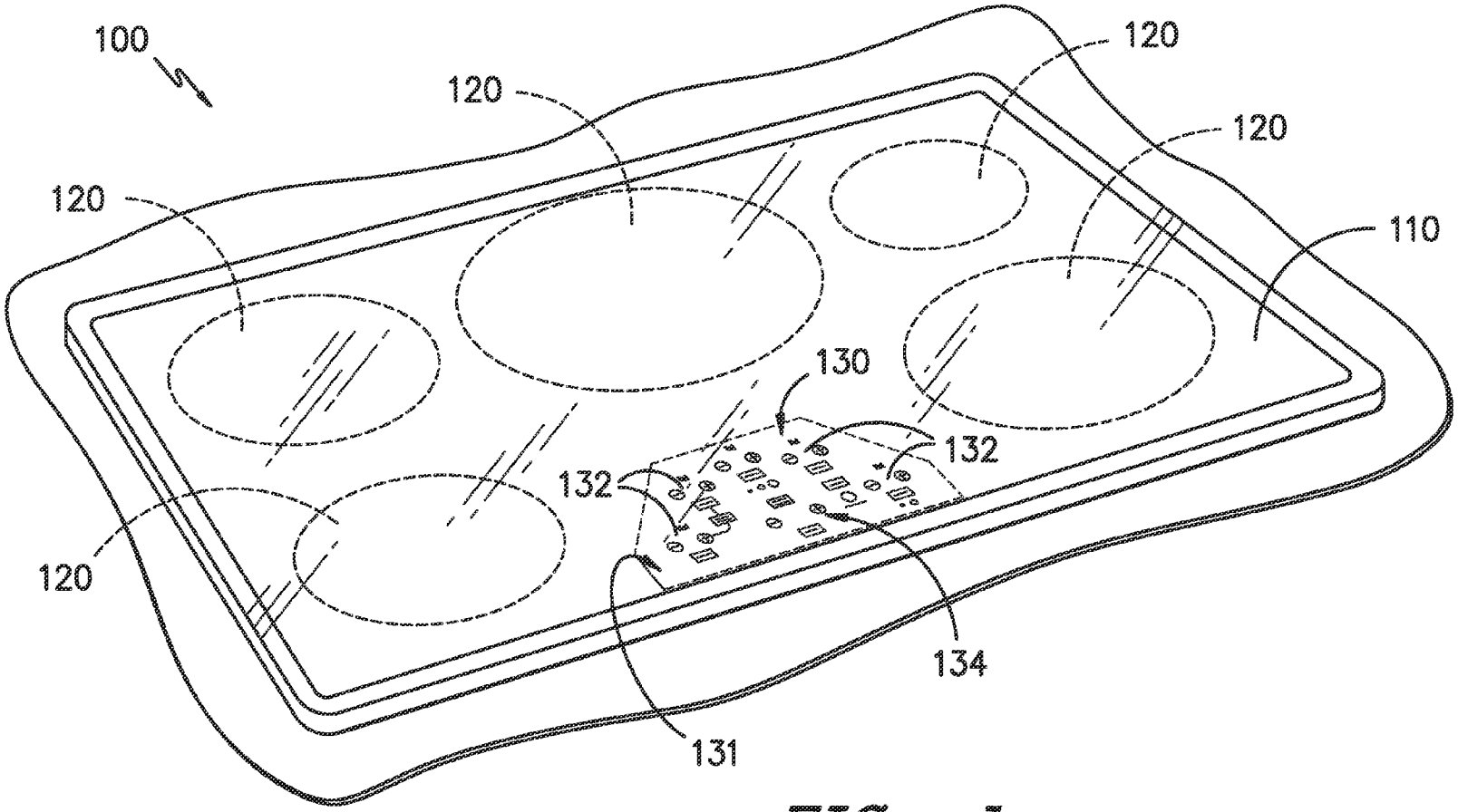
FIG. 1 provides a top perspective view of an exemplary embodiment of a cooktop appliance of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a top, perspective view of a cooktop appliance 100 according to an exemplary embodiment of the present subject matter. Cooktop appliance 100 can be installed in various locations such as in cabinetry in a kitchen, with one or more ovens to form a range appliance, or as a standalone appliance. Thus, as used herein, the term "cooktop appliance" includes grill appliances, stove appliances, range appliances, and other appliances that incorporate cooktops, which are generally known as surface cooking appliances.

Cooktop appliance 100 includes a panel 110 for supporting thereon cooking utensils such as pots or pans. Panel 110 may be constructed from, e.g., glass, ceramics, and/or combinations thereof. Heating assemblies 120 are mounted below panel 110 such that heating assemblies 120 are positioned below panel 110, e.g., along a vertical direction V. While shown with five heating assemblies 120 in the exemplary embodiment of FIG. 1, cooktop appliance 100 may include any number of heating assemblies 120 in alternative exemplary embodiments. Heating assemblies 120 can also have various diameters. For example, each heating assembly 120 can have a different diameter, the same diameter, or any suitable combination thereof. Further, each heating assembly 120 may include one or more heating elements or zones.

Cooktop appliance 100 is provided by way of example only and is not limited to the exemplary embodiment shown in FIG. 1. For example, a cooktop appliance having one or more heating assemblies in combination with one or more electric or gas burner heating elements can be provided. In addition, various combinations of number of heating assemblies, position of heating assemblies, and/or size of heating assemblies can be provided. Moreover, heating assemblies 120 can have a variety of constructions for the input of energy in the form of heat to the cooking utensils. For example, heating assemblies can be constructed as electric radiant, electric induction, or gas-on-glass heating sources. Mechanisms associated with each such type of heating source are positioned under panel 110 and will be well understood by one of skill in the art using the teachings disclosed herein.

A user interface 130 of a user interface assembly 136 (FIG. 2) provides visual information to a user and allows a user to select various options for the operation of cooktop appliance 100. For example, displayed options can include a desired heating assembly 120, a desired cooking temperature, and/or other options. User interface 130 can be any type of input device and can have any configuration. In FIG. 1, user interface 130 is located within a portion of panel 110. Alternatively, user interface 130 can be positioned on a vertical surface near a front side of cooktop appliance 100 or anywhere convenient for a user to access during operation of cooktop appliance 100. In some embodiments, cooktop appliance 100 may be a range cooktop, and in such embodiments, user interface 130 may be positioned on, e.g., a rear backsplash or front bezel of the range.

Also, although described with respect to cooktop appliance 100, it should be readily understood that user interface assembly 136 as described herein could be used with any suitable appliance. When used with other appliances, such as, e.g., washing machine appliances, dryer appliances, and/or refrigerator appliances, panel 110 may be constructed of glass, ceramics, plastics, and/or combinations thereof. Suitable plastic materials may include acrylics, polyethylene terephthalate ("PET"), or the like. In some embodiments, user interface 130 may be incorporated into or may form the control panel of an appliance; for example, user interface 130 may be incorporated into a backsplash of a washing machine or dryer appliance.

In the exemplary embodiment shown in FIG. 1, user interface 130 includes one or more capacitive touch input components 132. Touch input components 132 can be used as part of a capacitive touch sensing system and can allow for the selective activation, adjustment, or control of any or all heating assemblies 120, as well as any timer features or other user adjustable inputs. One or more of a variety of electrical, mechanical, or electro-mechanical input devices including rotary dials, push buttons, toggle/rocker switches, and/or touch pads can also be used singularly or in combination with touch input components 132. User interface 130 also includes a display component 134, such as a digital or analog display device designed to provide operational feedback to a user. User interface 130 further may be provided with one or more graphical display devices that deliver certain information to the user such as, e.g., whether a particular heating assembly is activated and the level at which the heating element is set.

Operation of cooktop appliance 100 can be regulated by a controller (not shown) that is operatively coupled to, i.e., in communication with, user interface 130, heating assemblies 120, and other operational components of appliance 100. For example, in response to user manipulation of a touch input component 132, the controller operates one of heating assemblies 120. The controller is also provided with other features. By way of example, the controller may include a memory and one or more processing devices such as microprocessors, CPUs, or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout cooktop appliance 100. In the illustrated embodiment, the controller may be located under or next to the user interface 130. In such an embodiment, input/output ("I/O") signals are routed between the controller and various operational components of appliance 100 such as, e.g., heating assemblies 120, touch input components 132, sensors, graphical displays, and/or one or more alarms. In one embodiment, user interface 130 may represent a general purpose I/O ("GPIO") device or functional block. User interface 130 may be in communication with the controller via one or more signal lines or shared communication busses.

Figure 2:
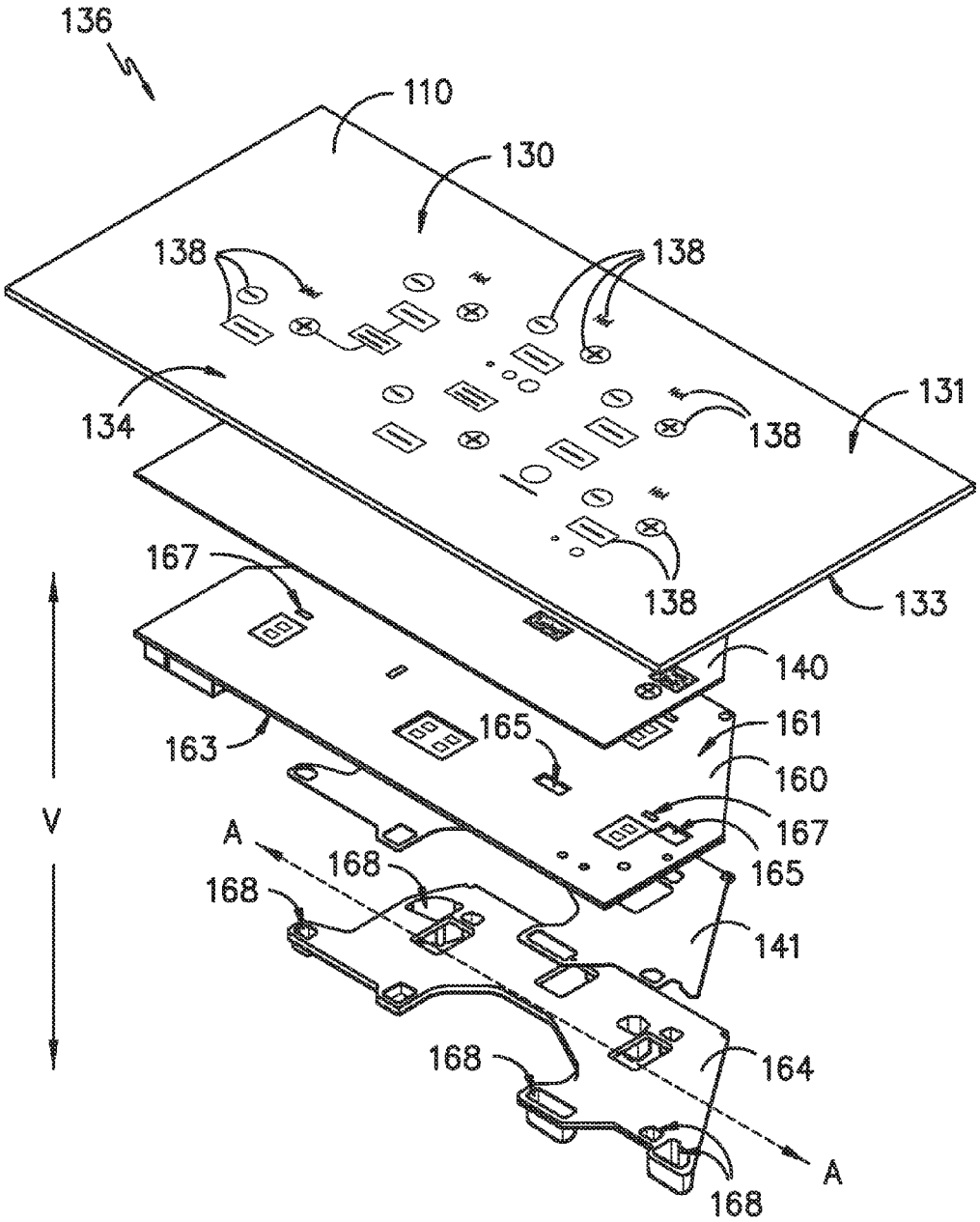
FIG. 2 provides an exploded view of an exemplary embodiment of a user interface assembly of the present subject matter.

FIG. 2 illustrates an exploded view of a user interface assembly 136 of cooktop appliance 100. As shown, a user of appliance 100 may input and receive information regarding the operation of appliance 100 at user interface 130, which is a portion of panel 110. More specifically, user interface 130 may include a user interface surface 131 that is accessible by the user, e.g., to input information regarding the operation of appliance 100. User interface 130 further may include an opposing surface 133 opposite user interface surface 131; for example, in the exemplary embodiment shown in FIG. 2, opposing surface 133 is spaced apart from user interface surface 131 along the vertical direction V such that user interface surface 131 is a top surface of user interface 130 and opposing surface 133 is a bottom surface of user interface 130.

A variety of text, digits, and/or symbols may be printed on user interface 130 to indicate, e.g., the heat setting of a heating assembly 120 or the area of user interface 130 to touch to input certain information. For example, text, digits, graphics, and/or symbols may be printed on user interface surface 131 or opposing surface 133 such that the printed text, digits, graphics, and/or symbols are always visible. In alternative embodiments, certain text, digits, or symbols may appear on user interface 130 only when appliance 100 is in use. For example, some or all of the text, digits, or symbols that appear on user interface 130 may be illuminated features 138, which are illuminated or lighted when appliance 100 is active or in use.

As shown in FIG. 2, a printed circuit board 160 is positioned below user interface 130 along the vertical direction V. Printed circuit board 160 includes a first surface 161 positioned adjacent opposing surface 133 of user interface 130. Further, printed circuit board 160 includes a second surface 163 opposite first surface 161, e.g., as shown in FIG. 2, second surface 163 may be spaced apart from first surface 161 along vertical direction V by the thickness of printed circuit board 160. In such embodiments, first surface 161 is a top surface of printed circuit board 160, and second surface 163 is a bottom surface of printed circuit board 160. Printed circuit board 160 may include one or more light sources 162 (FIG. 3) positioned on second surface 163 for illuminating the one or more features 138 of user interface 130 that may be, e.g., text, graphics, and/or symbols appearing on user interface 130. Each light source 162 may be, e.g., a light emitting diode ("LED"), an incandescent lamp, or any other appropriate light source. As further described below, the controller may activate and/or deactivate one or more light sources 162 as needed to illuminate or darken various illuminated features of user interface 130.

Printed circuit board 160 may also include other features for controlling user interface 130 and/or appliance 100. For example, printed circuit board 160 may include a capacitive touch sensing system, whereby cooktop 100 is controlled at least in part through touch inputs on user interface 130 by a user of cooktop 100, e.g., through capacitive touch input components 132. Additionally or alternatively, printed circuit board 160 may include a plurality of apertures, such as, e.g., first apertures 165 and second apertures 167, for the passage of light from light sources 162 to user interface 130.

Figure 3:
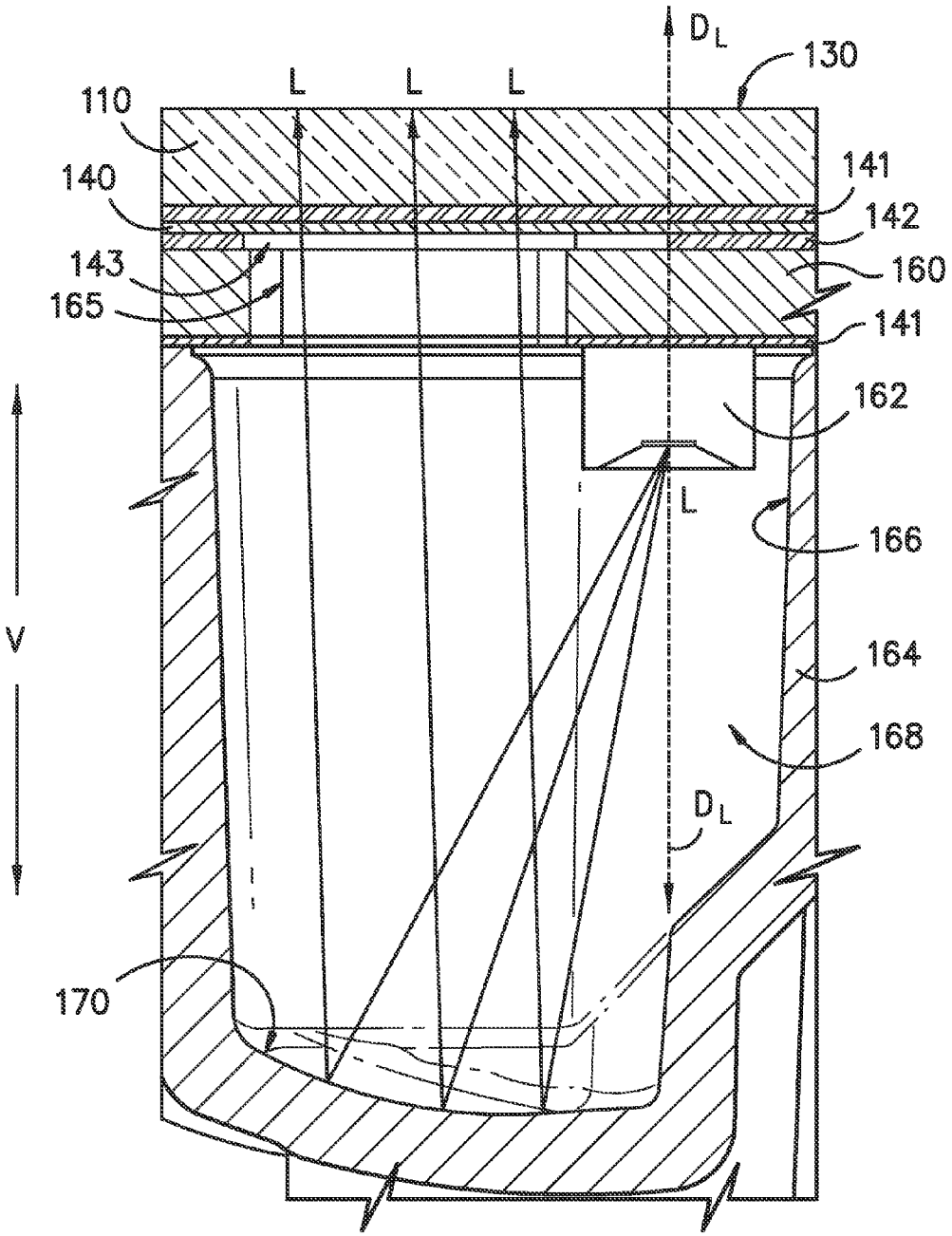
FIG. 3 provides a cross-section view of an exemplary embodiment of a user interface assembly of the present subject matter.

As further shown in FIG. 2, a light transmissive layer 140 is disposed between user interface 130 and light source or sources 162. More particularly, in the illustrated embodiment, light transmissive layer 140 is disposed between opposing surface 133 of user interface 130 and first surface 161 of printed circuit board 160. One or more layers of adhesive 141, 142 (FIG. 3), such as, e.g., transfer tape, may be used to bond light transmissive layer 140 to panel 110 and printed circuit board 160; in this way, light transmissive layer 140 serves not only to diffuse the light but also to bond circuit board 160 to user interface 130. In alternative embodiments, light transmissive layer 140 may be secured in place by alignment pins (not shown) such that a layer of adhesive 141 and/or 142 is not needed. Each layer of adhesive 141,142 may be composed of the same adhesive material or may be composed of different adhesive materials, e.g., an appropriate adhesive 141 may be selected for bonding light transmissive layer 140 to panel 110 and another appropriate adhesive 142 may be selected for bonding light transmissive layer 140 to printed circuit board 160. Further, as illustrated in FIG. 3, adhesive 141, 142 may be selectively applied such that there are one or more voids 143 in a layer of adhesive 141, 142. Voids 143 may, e.g., aid in the assembly of light transmissive layer 140, allow light from light sources 162 to pass unimpeded through a layer of adhesive 141, 142, or result from efficient application of adhesive 141, 142.

In some embodiments, light transmissive layer 140 is a light diffusion layer, i.e., a diffuser, that diffuses the light from light sources 162 to provide uniform lighting of the illuminated text, digits, graphics, or other features on user interface 130 and may be, e.g., a frosted PET film. In other embodiments, light transmissive layer 140 is a graphics overlay, masking, or support layer that may be a clear layer of, e.g., a PET film for providing various graphics on user interface 130 by passing light through layer 140. Using a masking material (not shown) applied to light transmissive layer 140, text, digits, and/or symbols may be formed such that the text, digits, and/or symbols are presented to the user of cooktop 100 when light from light source 162 is directed through light transmissive layer 140. Additionally or alternatively, the masking material may be used to mask various features of the construction of user interface assembly 136 and/or appliance 100, e.g., circuit board pads, part labels, etc., such that the features are not visible to a user of appliance 100. The masking material may be, e.g., a black ink or the like printed on one or more surfaces of light transmissive layer 140.

As shown in FIG. 2, user interface assembly 136 may utilize one or more light guides 164 to guide light from light sources 162 toward user interface 130. Light guides 164 may be of any suitable size and shape for guiding light from the one or more light sources 162 toward user interface 130. Light guides 164 may be formed with air channels for guiding light toward user interface 130 or light guides 164 may comprise light pipes to convey light from light source 162 to user interface 130. Other configurations of light guides 164 may also be used.

In the exemplary embodiment illustrated in FIG. 2, light guide 164 is constructed as a single piece and is positioned adjacent second surface 163 of printed circuit board 160. Light guide 164 includes a plurality of reflector boxes 168 and is held in place against second surface 163 of printed circuit board 160 with a layer of adhesive 141. In alternative embodiments, light guide 164 may be constructed of one or more pieces, each piece having one or more reflector boxes 168. In such embodiments, each piece of light guide 164 may be individually bonded to second surface 163 of printed circuit board 160. Further, although illustrated with adhesive 141 holding light guide 164 in place against second surface 163 of circuit board 160, in some embodiments, adhesive 141 may be omitted, and light guide 164 may be held in place by any suitable means.

Referring now to FIG. 3, light sources 162 may positioned on printed circuit board 160 such that light rays L from one or more light sources 162 are directed away from panel 110 and user interface surface 131, i.e., light from light sources 162 is not directed toward user interface 130. In some embodiments, light rays L from one or more light sources 162 may be directed generally 180°, or in the opposite direction, from user interface 130. In other embodiments, light rays L from one or more light sources 162 may be directed generally 90° from, or parallel to, user interface 130.

As shown in FIG. 3, each reflector box 168 of light guide 164 surrounds one or more light sources 162 to guide light rays L from light sources 162 toward user interface 130 by redirecting the light, i.e., light rays L from light source 162 are reflected off interior surface 166 of reflector box 168 and thereby directed toward user interface 130. More particularly, reflector box 168 may define as a portion of its interior surface 166 a primary reflective surface 170 spaced apart from light source 162 and positioned such that light rays L from light source 162 are directed toward primary reflective surface 170.

Figure 4:
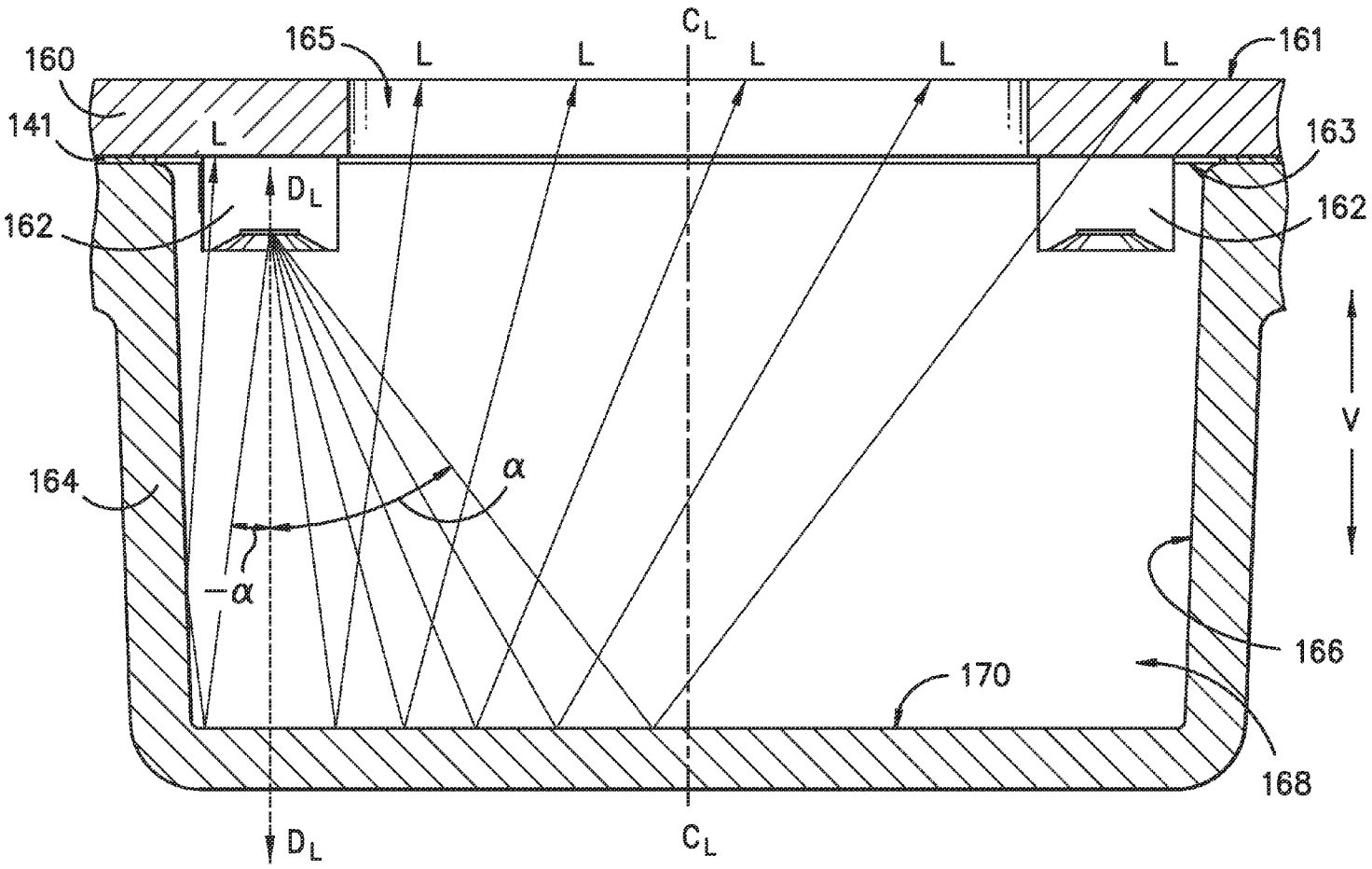
FIG. 4 PRIOR ART
FIG. 4 provides a cross-section view of a reflector box in accordance with a known configuration of a reflector box.

FIG. 4 illustrates the path of light rays L from one light source 162 reflected by a primary reflective surface 170 that is generally flat or parallel to printed circuit board 160, according to one known configuration of reflector box 168. As shown, without shaping or sculpting primary reflective surface 170 to direct light uniformly and/or evenly across one or more features 138 of user interface 130, light rays L from light source 162 reflected by primary reflective surface 170 are not uniformly or evenly distributed within first aperture 165. Additionally, light source 162 may define through a centerline of the light source a light direction $D_L$ that is perpendicular to user interface surface 131 and/or printed circuit board 160. FIG. 4 illustrates that, without specifically shaping surface 170, some light L is lost, e.g., light rays L that are at a negative angle $-\alpha$ to the light direction $D_L$ are reflected away from first aperture 165, and light rays L at a relatively large positive angle $\alpha$ to light direction $D_L$ miss, e.g., over-shoot past, first aperture 165. Further, although FIG. 4 illustrates the path of light rays L from only one light source 162 surrounded by reflector box 168, the path of light rays L from the other light source 162 shown within reflector box would be substantially similar, i.e., essentially a mirror image of the illustrated light rays L, or the pattern of light rays L within reflector box 168 is essentially symmetric about a centerline $C_L$ through reflector box 168. As a result, the feature 138 to be lighted or illuminated by light sources 162 will be dimly and unevenly lit, with brighter spots, or hot spots, closer to light sources 162.

Figure 5:
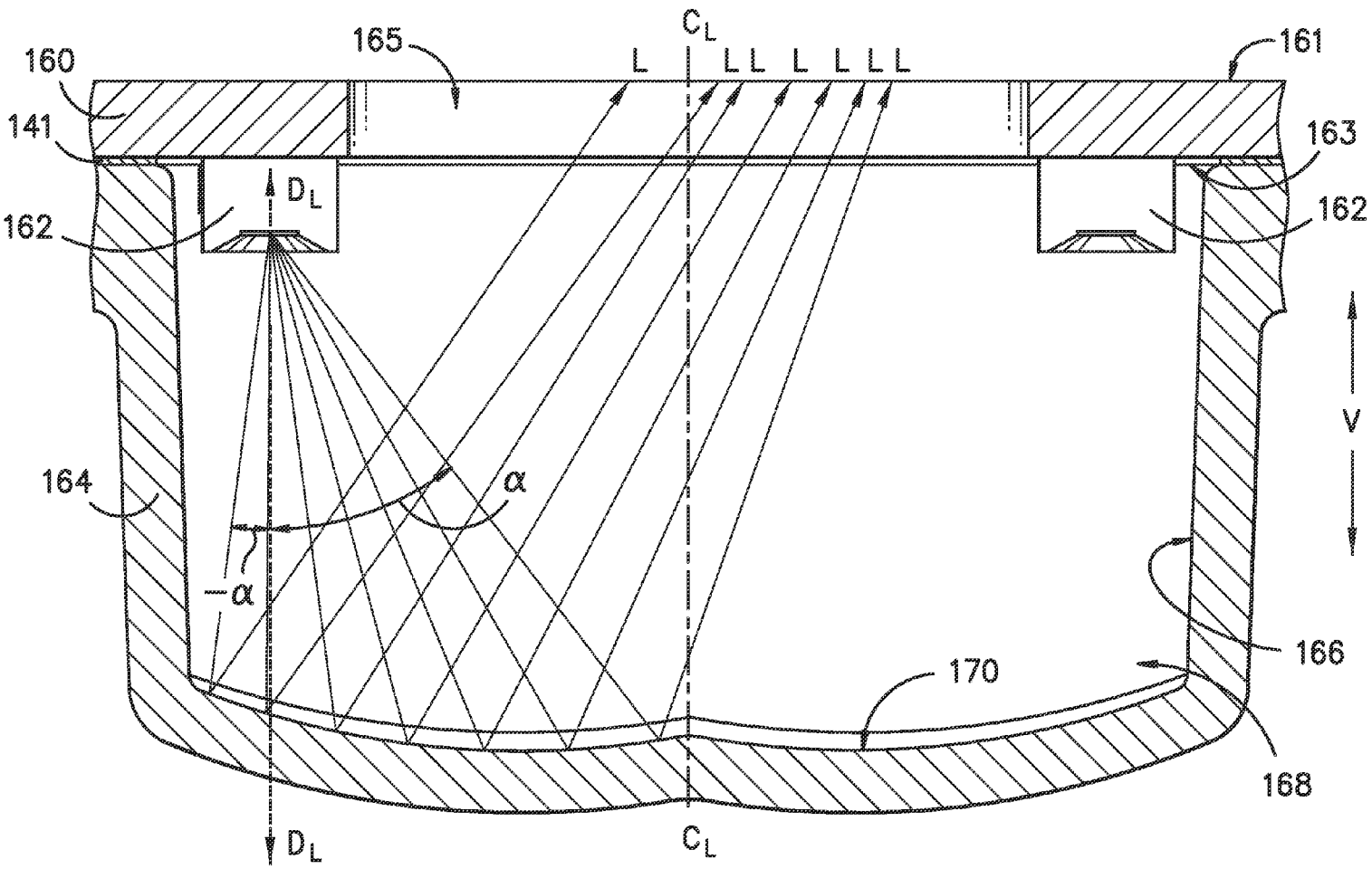
FIG. 5 provides a cross-section view of an exemplary embodiment of a reflector box of the present subject matter.
Figure 6:
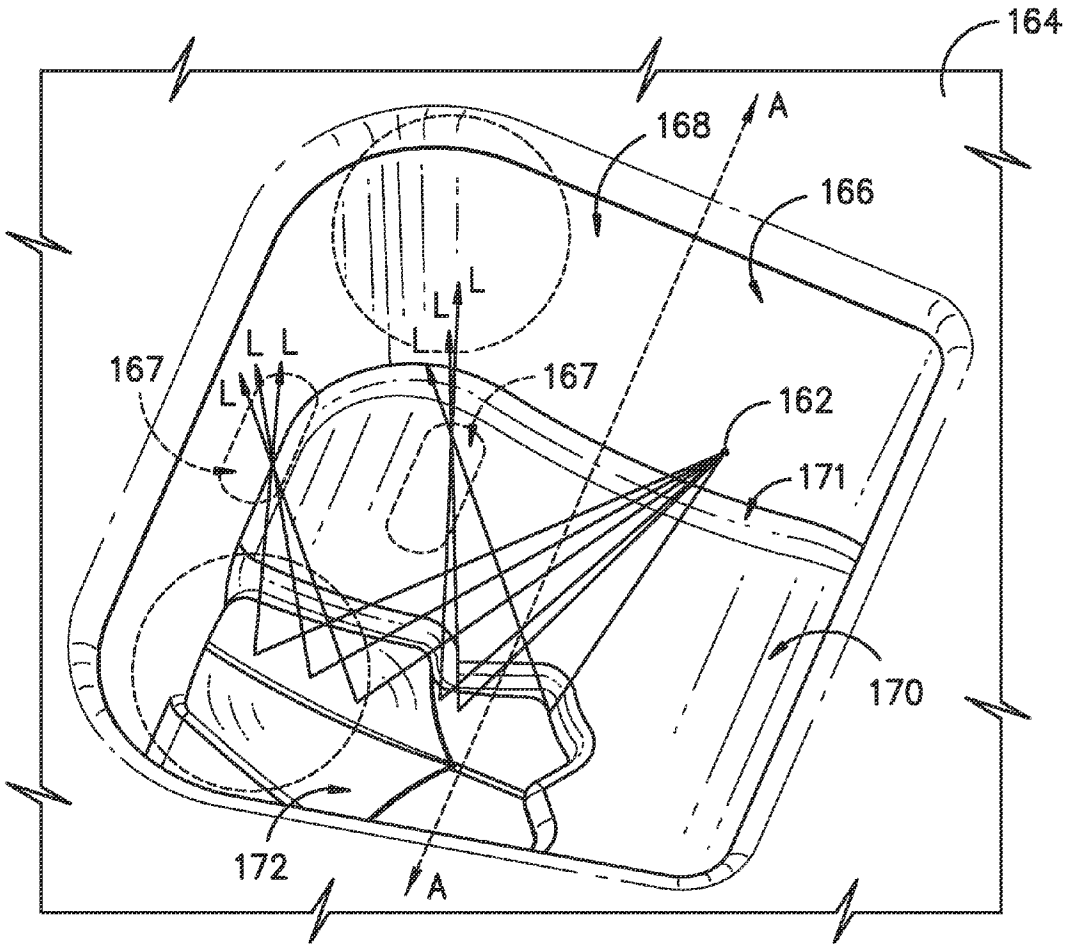
FIG. 6 provides a top, perspective view of an exemplary embodiment of a light reflector box of the present subject matter.

In contrast, light rays L that are uniformly distributed within first aperture 165 pass through light transmissive layer 140 (if a light transmissive layer 140 is provided) and panel 110 to uniformly and/or evenly illuminate one or more features 138 of user interface 130 defined above aperture 165. As shown in FIGS. 3, 5, and 6 illustrating exemplary embodiments of the present subject matter, primary reflective surface 170 may be shaped or sculpted to reflect light rays L from light source 162 to first aperture 165 in printed circuit board 160 such that light rays L are distributed essentially uniformly within first aperture 165. For example, as shown in FIG. 5, primary reflective surface 170 is located opposite light source 162 such that light L from light source 162 is directed toward primary reflective surface 170. Primary reflective surface 170 may be pseudo-parabolic in shape to reflect light rays L from light source 162 to first aperture 165 such that light rays L are distributed essentially uniformly and/or evenly within first aperture 165. Primary reflective surface 170 may be pseudo-parabolic or curvilinear in shape with respect to each light source 162 from which surface 170 reflects light rays L, as illustrated in FIG. 5, or surface 170 overall may be pseudo-parabolic or curvilinear in shape.

As further shown in FIG. 5, primary reflective surface 170 may be shaped such that surface 170 directs into first aperture 165 light rays L from light source 162 that are parallel to light direction DL, are at a negative angle $-\alpha$ to light direction DL, and are a positive angle $\alpha$ to light direction DL to uniformly and evenly distribute light from light source 162 within first aperture 165. Angle $\alpha$ may represent the beam angle of light source 162 and may range from approximately −90° to approximately 90°. Further, each light ray L may be at a different angle $\alpha$ with respect to light direction $D_L$; therefore, the shape of primary reflective surface 170 should account for the range and variation of angles at which light rays L contact surface 170. Also, although FIG. 5 illustrates the path of light rays L from only one light source 162 surrounded by reflector box 168, the path of light rays L from the other light source 162 shown within reflector box would be similar, i.e., essentially a mirror image of the illustrated light rays L, or the pattern of light rays L within reflector box 168 is essentially symmetric about a centerline CL through reflector box 168. Thus, light rays L from each light source 162 that are reflected by reflector box 168 are distributed uniformly and/or evenly within first aperture 165 such that the associated feature or features 138 of user interface 130 are uniformly and/or evenly illuminated. It can be appreciated that, in addition to more uniformly distributing the light rays within aperture 165 of printed circuit board 160, another advantage of the shaped and/or sculpted primary reflective surface 170 is that more light rays L of light source 162 are directed into aperture 165, rather than reflecting back to light source 162 if the beam angle is negative or passing by aperture 165 to the far side of reflector box 168 if the beam angle is too great, i.e., too positive. Thus, using shaped and/or sculpted primary reflective surface 170, more emitted light reaches the desired area (aperture 165) rather than bouncing around within light guide 164 and being substantially lost or unused.

As an additional example illustrated in FIG. 6, primary reflective surface 170 may be swept along an axis A that is parallel to panel 110. For example, surface 170 may be formed by first creating a shape through the optimization of ray-tracing techniques on a plane passing through light source 162 and an aperture 165 and then extruding the shape or sweeping the shape along a linear path. As also shown in FIG. 6, reflector box 168 may define a rounded, curved, or beveled transition portion 171 between primary reflective surface 170 and other portions of interior surface 166 of reflector box 168. Primary reflective surface 170 and reflector box 168 may have other shapes and/or configurations as well to evenly illuminate text, graphics, symbols, and other features 138 of user interface 130.

In some embodiments, as shown in FIG. 6, primary reflective surface 170 may define a secondary reflective surface 172. Secondary reflective surface 172 may be at a different height or depth than primary reflective surface 170 and generally has a different shape to optimize the reflection of certain angles of light rays L into specific regions of aperture 165 so as to enhance and/or brighten select regions of the symbol/graphic being illuminated. Additionally or alternatively, a rounded, curved, or beveled transition portion 171 may be defined between surfaces 170 and 172.

Like primary reflective surface 170, secondary reflective surface 172 is spaced apart from light source 162 and positioned such that at least a portion of light rays L from light source 162 are directed toward surface 172. Secondary reflective surface 172 may be shaped or sculpted to reflect light rays L from light source 162 to an aperture defined by printed circuit board 160 such that the light rays L are distributed uniformly and/or evenly within the aperture. As such, like primary reflective surface 170, secondary reflective surface 172 may be pseudo-parabolic or curvilinear in shape, may be revolved about or translated along an axis, and/or may reflect light rays L that are parallel, at a negative angle $\alpha$, or at a positive angle $\alpha$ to light direction DL. As an example, surface 172 may be formed by first creating a shape through the optimization of ray-tracing techniques on a plane passing through an aperture 167 and then revolving or rotating the shape about an axis passing through light source 162 perpendicular to user interface 130. Secondary reflective surface 172 also may have other shapes and/or configurations.

Like primary reflective surface 170, secondary reflective surface 172 is spaced apart from light source 162 and positioned such that at least a portion of light rays L from light source 162 are directed toward surface 172. Secondary reflective surface 172 may be shaped or sculpted to reflect light rays L from light source 162 an aperture defined by printed circuit board 160 such that the light rays L are distributed uniformly and/or evenly within the aperture. As such, like primary reflective surface 170, secondary reflective surface 172 may be pseudo-parabolic or curvilinear in shape, may be revolved about or translated along an axis, and/or may reflect light rays L that are parallel, at a negative angle $\alpha$, or at a positive angle $\alpha$ to light direction $D_L$. As an example, surface 172 may be formed by first creating a shape through the optimization of ray-tracing techniques on a plane passing through an aperture 167 and then revolving or rotating the shape about an axis passing through light source 162 perpendicular to user interface 130. Secondary reflective surface 172 also may have other shapes and/or configurations.

Light rays L reflected by secondary reflective surface 172 may be directed toward first aperture 165 or second aperture 167 of printed circuit board 160. In some embodiments, secondary reflective surface 172 may assist or work with primary reflective surface 170 to provide uniform and/or even light to first aperture 165 such that a feature 138 of user interface 130 may be uniformly and/or evenly illuminated. In other embodiments, primary reflective surface 170 directs light to first aperture 165 and secondary reflective surface 172 reflects light to second aperture 167 such that more than one feature 138 of user interface 130 or the details of a feature 138 may be uniformly and/or evenly illuminated using one reflector box 168. Second aperture 167 may be smaller than first aperture 165, e.g., second aperture 167 may have a smaller area for the passage of light rays L therethrough. Thus, as shown in FIG. 6, secondary reflective surface 172 may be shaped to reflect light L uniformly and/or evenly within one or more second apertures 167 while primary reflective surface 170 is shaped to reflect light L uniformly and/or evenly within one or more first apertures 165. Thereby, in some embodiments, light L reflected by secondary reflective surface 172 may fill in or add more light to small details of feature 138 that also is illuminated by light L reflected by primary reflective surface 170. That is, in such embodiments, light reflected by secondary surface 172 may enhance and/or brighten the illumination of a sub-feature within a larger illuminated feature 138 of user interface 130 such that feature 138 is uniformly and/or evenly lit, without bright or hot spots. In other embodiments, light L reflected by surface 172 may illuminate a separate feature 138 from a feature 138 illuminated by surface 170 such that both features 138 are uniformly and/or evenly illuminated.

Thus, to achieve essentially even and/or uniform illumination within aperture 165, primary reflective surface 170 is not a simple flat surface but, rather, a potentially complex shape derived by ray-tracing techniques on one plane. The shape is then either extruded or revolved in a perpendicular plane to achieve the complex reflective surface in three dimensions. In its simplest form, primary reflective surface 170 has a generally circular profile, which converts the radially-expanding light rays L emanating from light source 162 into essentially parallel light rays that pass through aperture 165 in printed circuit board 160 to uniformly and/or evenly illuminate one or more features 138 of user interface 130. The shape of secondary reflective surface 172 may be derived and constructed in a similar manner with other light-focusing goals in mind.

Accordingly, reflector box 168 may be configured or constructed such that user interface assembly is a low cost, easy-to-assemble interface capable of illuminating both large and small text, graphics, symbols, and the like. By shaping primary reflective surface 170 and/or secondary reflective surface 172 to reflect light rays L from one or more light sources 162 such that the light is uniformly and/or evenly distributed across associated features 138 of user interface 130, an injection molded plastic light guide 164 and/or a minimum number of light sources 162 may be used, and such light sources may be standard, low cost light sources such as, e.g., surface mounted LEDs.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A user interface assembly for an appliance, comprising:

a panel having a user interface surface accessible by a user of the user interface assembly and an opposing surface opposite the user interface surface;

a printed circuit board having a first surface opposite a second surface, the first surface positioned adjacent the opposing surface of the panel, the printed circuit board defining a first aperture therethrough;

a light source positioned on the second surface of the printed circuit board, the light source positioned such that light rays from the light source are not directed toward the user interface surface;

a primary reflective surface spaced apart from the light source, the primary reflective surface positioned such that light rays from the light source are directed toward the primary reflective surface, the primary reflective surface being shaped to reflect the light rays from the light source to the first aperture in the printed circuit board such that the light rays are distributed essentially uniformly within the first aperture.

2. The user interface assembly of claim 1, wherein the primary reflective surface is pseudo-parabolic in shape.

3. The user interface assembly of claim 1, wherein the primary reflective surface is swept along an axis parallel to the panel.

4. The user interface assembly of claim 1, wherein the primary reflective surface is defined by a reflector box surrounding the light source and the first aperture.

5. The user interface assembly of claim 1, wherein the light source defines a light direction through a centerline of the light source, the light direction being perpendicular to the user interface surface, and wherein the primary reflective surface directs into the first aperture light rays from the light source that are parallel to the light direction, are at a negative angle to the light direction, and are at a positive angle to the light direction.

6. The user interface assembly of claim 1, further comprising a secondary reflective surface spaced apart from the light source, the secondary reflective surface positioned such that the light rays from the light source are directed toward the secondary reflective surface, the secondary reflective surface being shaped to reflect at least a portion of the light rays from the light source to a second aperture defined by the printed circuit board such that the light rays are distributed uniformly within the second aperture.

7. The user interface assembly of claim 6, wherein the secondary reflective surface is pseudo-parabolic in shape.

8. The user interface assembly of claim 6, wherein the second aperture is smaller than the first aperture.

9. The user interface assembly of claim 6, wherein the primary reflective surface defines the secondary reflective surface.

10. A user interface assembly for an appliance, comprising:

a panel including a user interface;

a light source for illuminating a feature of the user interface, the light source positioned such that light rays from the light source are not directed toward the user interface; and a primary reflective surface located opposite the light source such that light rays from the light source are directed toward the primary reflective surface, the primary reflective surface being shaped to reflect the light rays toward the feature of the user interface such that the light rays are essentially uniformly distributed within the user it feature being illuminated, wherein the light source defines a light direction through a centerline of the light source, the light direction being perpendicular to the user interface, and wherein the primary reflective surface directs to the feature of the user interface light rays from the light source that are parallel to the light direction, are at a negative angle to the light direction, and are at a positive angle to the light direction.

11. The user interface assembly of claim 10, wherein the primary reflective surface is pseudo-parabolic in shape.

12. The user interface assembly of claim 10, wherein the primary reflective surface is swept along an axis parallel to the panel.

13. The user interface assembly of claim 10, wherein the primary reflective surface is defined by a reflector box that surrounds the light source.

14. The user interface assembly of claim 10, further comprising a printed circuit board defining an aperture therethrough, the light source positioned on the printed circuit board such that light rays from the light source reflected by the primary reflective surface are reflected through the aperture defined by the printed circuit board.

15. The user interface assembly of claim 10, further comprising a secondary reflective surface located opposite the light source such that light rays from the light source are directed toward the secondary reflective surface, the secondary reflective surface being shaped to reflect the light rays toward a feature of the user interface such that the light rays are essentially uniformly distributed within the feature.

16. The user interface assembly of claim 15, wherein the secondary reflective surface is pseudo-parabolic in shape.

17. The user interface assembly of claim 15, wherein light rays reflected by the primary reflective surface and the secondary reflective surface are essentially uniformly distributed within one feature of the user interface.

18. The user interface assembly of claim 15, wherein the primary reflective surface defines the secondary reflective surface.

19. A user interface assembly for an appliance, comprising:

a panel including a user interface;

a light source for illuminating a feature of the user interface, the light source positioned such that light rays from the light source are not directed toward the user interface; and a primary reflective surface located opposite the light source such that light rays from the light source are directed toward the primary reflective surface, the primary reflective surface being shaped to reflect the light rays toward the feature of the user interface such that the light rays are essentially uniformly distributed within the user interface feature being illuminated, wherein the primary reflective surface is defined by a reflector box that surrounds the light source.

* * * * *